US010767831B2

(12) United States Patent
Menn

(10) Patent No.: US 10,767,831 B2
(45) Date of Patent: Sep. 8, 2020

(54) MOTOR VEHICLE HEADLIGHT AIR EXTRACTOR

(71) Applicant: VALEO VISION, Bobigny (FR)

(72) Inventor: Thibaut Menn, Bobigny (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 16/434,378

(22) Filed: Jun. 7, 2019

(65) Prior Publication Data

US 2019/0376660 A1 Dec. 12, 2019

(30) Foreign Application Priority Data

Jun. 8, 2018 (FR) ..... 18 55040

(51) Int. Cl.
*F21S 45/33* (2018.01)
*F21S 45/43* (2018.01)
*F21S 45/49* (2018.01)

(52) U.S. Cl.
CPC ..... *F21S 45/33* (2018.01); *F21S 45/43* (2018.01); *F21S 45/49* (2018.01)

(58) Field of Classification Search
CPC .. F21S 45/20; F21S 45/30; F21S 45/33; F21S 45/42; F21S 45/43; F21S 45/49
See application file for complete search history.

(56) References Cited

U.S. PATENT DOCUMENTS 4,809,144 A * 2/1989 Suzuki ..... F21S 45/33 362/547
5,230,719 A * 7/1993 Berner ..... F24F 3/1411 165/4
6,045,248 A * 4/2000 Ashizawa ..... F21S 45/33 362/547
6,497,507 B1 12/2002 Weber
7,736,041 B2 * 6/2010 Tronquet ..... F21V 29/02 362/547
2005/0157514 A1 * 7/2005 Brinkmann ..... F21S 45/33 362/547
2006/0150817 A1 * 7/2006 DeGuiseppi ..... B01D 53/261 96/108
2009/0268475 A1 * 10/2009 Ball ..... F21V 29/83 362/373
2015/0050877 A1 * 2/2015 Yano ..... F24F 7/007 454/338

(Continued)

FOREIGN PATENT DOCUMENTS

DE 10 2009 055 681 A1 5/2011
DE 10 2013 218 327 A1 3/2015

(Continued)

OTHER PUBLICATIONS

French Preliminary Search Report dated Mar. 8, 2019 in French Application 18 55040, filed on Jun. 8, 2018 (with English Translation of Categories of Cited Documents).

*Primary Examiner* — Alexander K Garlen
(74) *Attorney, Agent, or Firm* — Oblon, McClelland, Maier & Neustadt, L.L.P.

(57) ABSTRACT

A vehicle headlight air extractor includes an air inlet and an air outlet, a ventilation chamber disposed between the air inlet and the air outlet of the air extractor, the ventilation chamber includes a fan adapted to produce a flow of air from the air inlet to the air outlet, and a sealing system against external particles.

19 Claims, 8 Drawing Sheets

(56) References Cited

U.S. PATENT DOCUMENTS

| | | | | |
|---|---|---|---|---|
| 2015/0070927 | A1* | 3/2015 | Kurahashi | B01D 53/26 362/546 |
| 2017/0108192 | A1* | 4/2017 | Dalal | F21S 45/33 |
| 2018/0073701 | A1* | 3/2018 | Shin | F21S 45/33 |
| 2018/0149334 | A1 | 5/2018 | Muehlbauer et al. | |

FOREIGN PATENT DOCUMENTS

| | | | |
|---|---|---|---|
| FR | 2 779 804 | A1 | 12/1999 |
| JP | 2002-124123 | | 4/2002 |

* cited by examiner

MOTOR VEHICLE HEADLIGHT AIR EXTRACTOR

BACKGROUND OF THE INVENTION

Field of the Invention

The invention concerns an air extractor for a headlight, in particular an air extractor for a motor vehicle headlight. The invention also relates to a headlight including an air extractor and a motor vehicle including a headlight of this kind. The invention finally concerns a method of using an air extractor of this kind.

Description of the Related Art

To improve the efficiency of headlights or the lighting modules in headlights, in particular in motor vehicle headlights, components of the light spatial modulator type may be used to form segmented beams that can be activated selectively. Light source matrices are one example of components of light spatial modulator type. However, these matrices heat up considerably because of their number and the rise in temperature rapidly degrades their performance.

Also known as another example of light spatial modulator type components are components of LCD screen type or matrices of micromirrors (also known as digital micromirror devices or DMD).

It would therefore be beneficial to integrate into a headlight components of light spatial modulator type such as MEMS (microelectromechanical systems), matrices of micromirrors, LCD screens or lasers.

However, the limit operating temperature of components of this kind is relatively low (around 85° C.), and it is therefore impossible to use them under the usual headlight temperature conditions. In fact, a headlight takes the form of a closed assembly including heat-generating elements positioned in the vicinity of an engine, the temperature inside the headlight can reach high values and the limit operating temperature of the components is rapidly exceeded.

Also, components of this kind require an environment that is sealed, in particular sealed against external particles. In fact, the presence of external particles can greatly reduce the performance of the electronic components in the headlight. The headlight must therefore be protected from the external environment.

To address these constraints there exist headlights that include heat exchangers coupled to fans positioned in the vicinity of the sensitive components in order to cool them directly.

However, a first disadvantage of such headlights is the number of additional manufacturing steps and the addition of a large number of extra components in small areas during manufacture.

A second disadvantage is that a system of this kind is complicated to repair in the event of a fan failing. It will therefore be preferable to replace the entire headlight or the housing containing the light spatial modulator type components, which involves additional costs.

BRIEF SUMMARY OF THE INVENTION

A general object of the invention is to provide a headlight solution improving the existing solutions and enabling the use of heat generating components without risk of exceeding their limit operating temperature.

To be more precise, a first object of the invention is to find a compromise allowing the use of light spatial modulator type components in a headlight so that their temperature is kept below the limit operating value at the same time as guaranteeing that the headlight is sealed.

A second object of the invention is to provide a headlight solution that is simple to implement at lower cost.

According to a first aspect, the invention concerns a vehicle headlight air extractor including: an air inlet and an air outlet; a ventilation chamber disposed between said air inlet and said air outlet of the air extractor, said ventilation chamber including a fan adapted to produce a flow of air from the air inlet to the air outlet; and a sealing system against external particles.

In one embodiment, the sealing system against external particles includes at least one blocking means designed to assume an open position and a closed position. The open position allowing fluidic communication between the air outlet and the air inlet and the closed position enabling prevention of at least the passage of the external particles between the air outlet and the air inlet.

In one embodiment, the air extractor includes a control device of the at least one blocking means.

In one embodiment, the at least one blocking means is arranged in the air outlet and/or in the air inlet.

In one embodiment, the at least one blocking means is mobile between the open position and the closed position by movement in rotation about an axis or by movement in translation.

In one embodiment, the sealing system against external particles includes, between the ventilation chamber and the air outlet, a channel having a bend.

In one embodiment, said channel has a slope when the air extractor is integrated into a headlight for evacuating liquid to the air outlet.

In one embodiment, the air outlet includes a grille.

In one embodiment, the air inlet includes an air guide oriented toward upper side of the air extractor.

According to a second aspect, the invention concerns a vehicle headlight including an air extractor according to the first aspect of the invention.

In one embodiment, the headlight further includes a headlight air inlet optionally including an air filter.

In one embodiment, the air extractor is arranged on an upper and/or rear part of the headlight.

In one embodiment, the headlight air inlet is arranged on a lower and/or front part of the headlight.

In one embodiment, the air extractor is removably fixed to the headlight.

In one embodiment, the headlight further includes at least one optical module including at least one electronic component and at least one system for cooling said electronic component, said cooling system including only a system for cooling by conduction. The at least one electronic component may be a light spatial modulator.

According to a third aspect, the invention concerns a method of controlling a headlight air extractor according to the second aspect of the invention in which the air extractor includes a mobile blocking means. Said method includes the following steps: activating the fan, then opening the at least one blocking means.

DETAILED DESCRIPTION OF THE INVENTION

Figure 1:
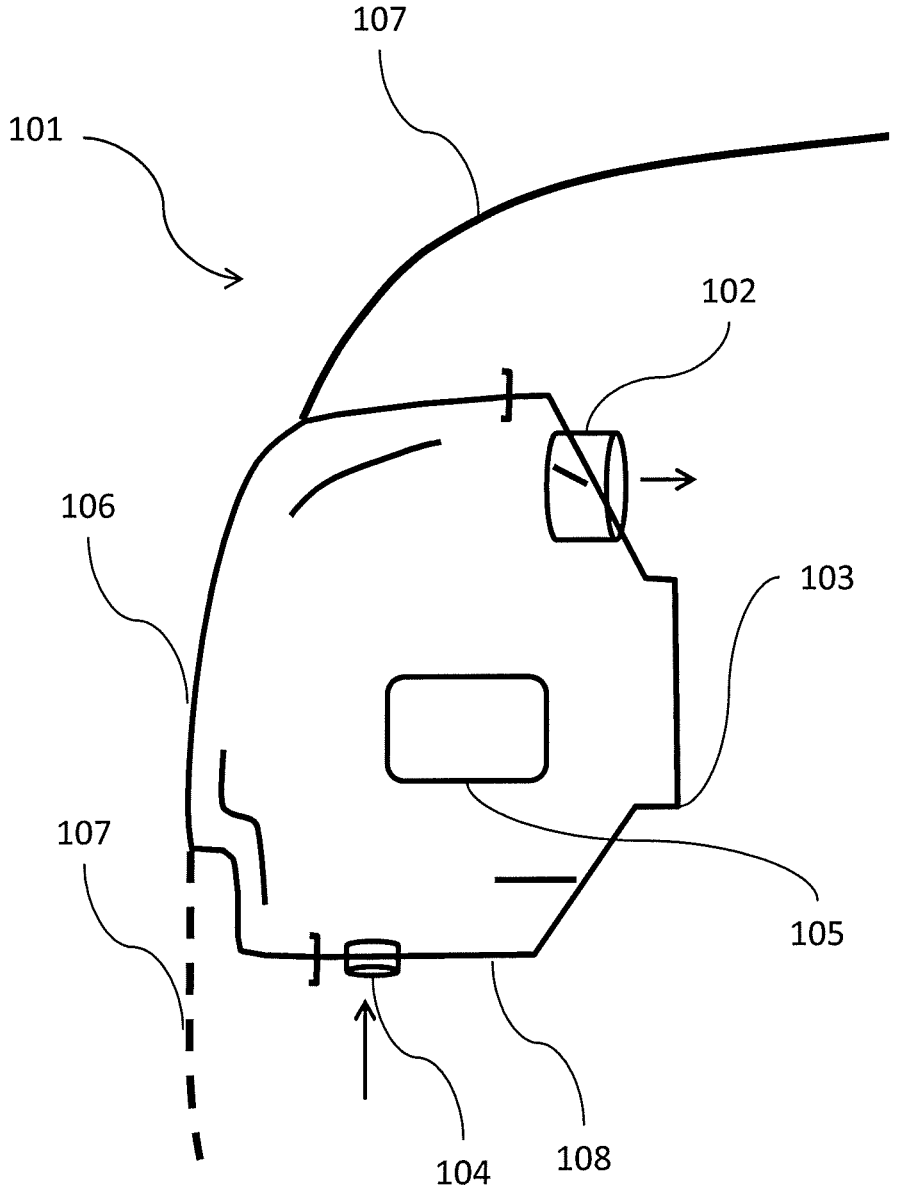
FIG. 1 is a diagram of the front of a vehicle including a headlight including an air extractor according to a first embodiment of the invention.

The following terms are defined in the remainder of the description and may be understood in the following manner:

We define as the longitudinal direction the direction oriented from the front toward the rear relative to a motor vehicle, the adjectives front and rear being defined relative to the usual motion of the vehicle. We define as a transverse direction the direction perpendicular to the longitudinal direction and oriented from the right to the left of a motor vehicle. The two longitudinal and transverse directions define a horizontal plane. The vertical direction is perpendicular to the horizontal plane and oriented upwards. These same directions are used for the description of a headlight with the headlight considered as if it were positioned in a vehicle.

The adjectives "upper" and "lower" are also used relative to the vertical direction defined hereinabove.

The expression "external particles" denotes an element present in the external environment of the headlight and liable to reduce the performance of the components present in the headlight through contact therewith. External particles may include, nonlimitingly, dust, water, oil splashes, washing product splashes and leaves.

The concept of the invention is based on the use of an air extractor, arranged at the level of a headlight, enabling evacuation of hot air present in the headlight to replace it with cool air, to reduce the average temperature of the air inside a headlight and consequently the temperature of the components positioned inside the headlight. This principle is shown diagrammatically in FIG. 1, which represents a headlight 103 mounted on a motor vehicle 101 equipped with an air extractor 102 according to one embodiment of the invention. An air extractor 102 of this kind is advantageously fixed to the headlight 103 in a removable manner in order to enable replacement thereof in the event of failure.

The headlight 103 includes at least one optical module 105. This optical module includes one or more temperature-sensitive components, including, for example, at least a component of the light spatial modulator type, a semiconductor component, an MEMS, a matrix of micromirrors, a liquid crystal screen or a laser.

This optical module advantageously includes a cooling system dedicated to the electronic component or components: however, because the optical module is integrated into a headlight including an air extractor according to one embodiment of the invention, which limits its average temperature, this dedicated cooling system may be simple and cooled only by conduction and by natural convection. The optical module therefore does not include a fan. It is therefore simplified compared to the usual optical modules including the same electronic components. The invention naturally remains compatible with these traditional optical modules including their own cooling system with a fan or fans.

By "natural convection" is meant convection that is not forced, that is to say produced without a fan or any other similar means enabling imposition of a flow of air locally in contact with or in the vicinity of the optical module.

The headlight 103 also includes an outer lens 106 arranged flush with or projecting from the bodywork 107 of the vehicle 101.

The air extractor 102 is arranged on or through a wall of the headlight 103. The air extractor is therefore able to provide fluidic communication between the interior and the exterior of the headlight 103. The air extractor 102 is adapted to enable extraction of air from the interior the headlight 103 to the exterior of the headlight. In one embodiment, the headlight includes a headlight air inlet 104. The hot air inside the headlight is therefore replaced by cooler air and the overall temperature of the air inside the headlight decreases.

The air extractor 102 is preferably arranged on the upper part of the headlight 103. In fact, hot air being less dense than cold air, the air inside the headlight 103 is hotter in the upper part of the headlight 103 than in the lower part. Arranging the air extractor 102 in the upper part of the headlight 103 therefore advantageously enables extraction of the hottest air to the exterior of the headlight 103 and thus favours the reduction in temperature of the air inside the headlight.

In one embodiment, the air extractor 102 includes an air guide the inlet of which is arranged on the upper part of the headlight 103. The air extractor 102 could then be arranged on a lower part or an intermediate part situated between the lower part and the upper part of the headlight 103, the air guide enabling hot air situated in the upper part of the headlight 103 to be fed to the extractor.

In one embodiment, an air inlet 104 of the headlight 103 is arranged on the lower part of the headlight. The air inlet 104 of the headlight may be arranged on the lower surface 108 of the headlight. The air inlet 104 of the headlight is preferably situated below a horizontal plane passing through the air extractor 102.

In one embodiment, the air inlet 104 of the headlight is arranged on the front part of the headlight 103, that is to say the part nearest the outer lens 106 of the headlight 103. This kind of arrangement of the air inlet 104 of the headlight advantageously enables cooler air to enter the interior of the headlight 103, in particular by moving the air inlet 104 of the headlight farther away from the engine of the vehicle 101, generally situated to the rear of the headlight 103.

In one embodiment, the air inlet 104 of the headlight includes an air guide the inlet of which is arranged on the front part and/or on the lower part of the headlight 103.

The air inlet 104 of the headlight may include an air filter. The air filter advantageously enables air to flow from the exterior to the interior of the headlight 103, preventing external particles from penetrating to the interior of the headlight 103 via the air inlet 104 of the headlight.

An example of an air extractor 201 according to a first embodiment is described hereinafter with reference to FIGS. 2A, 2B and 2C.

Figure 2A:
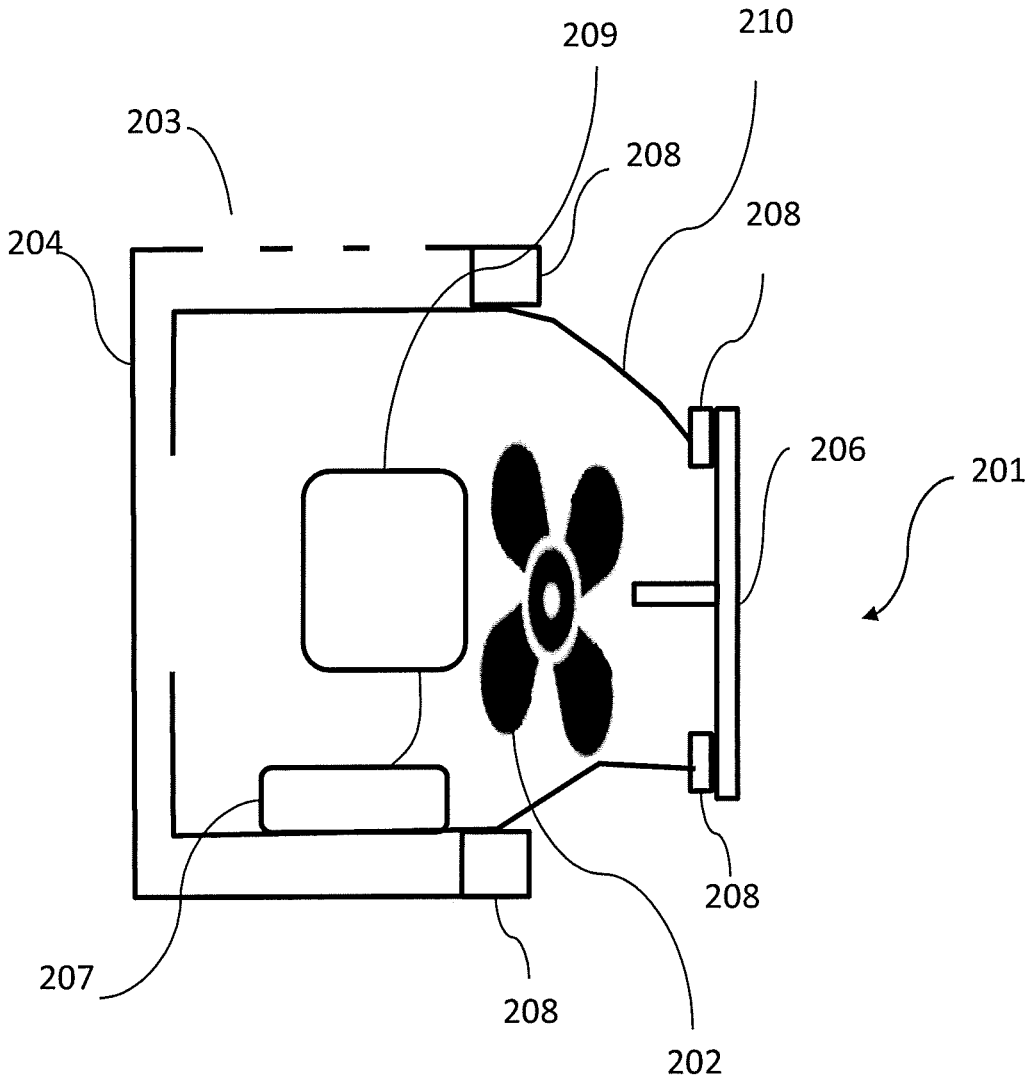
FIG. 2A represents an air extractor according to one embodiment of the invention in which the sealing system includes a flap.
Figure 2B:
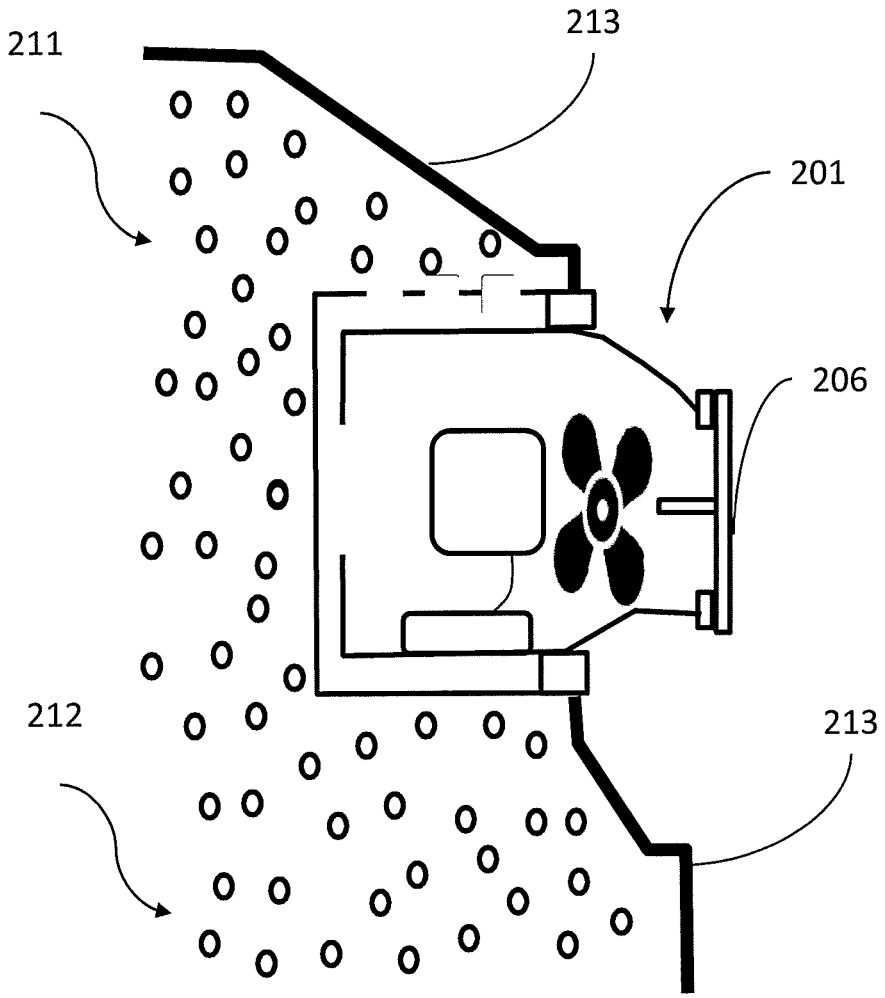
FIG. 2B represents the air extractor shown in FIG. 2A in which the flap is in a closed position.
Figure 2C:
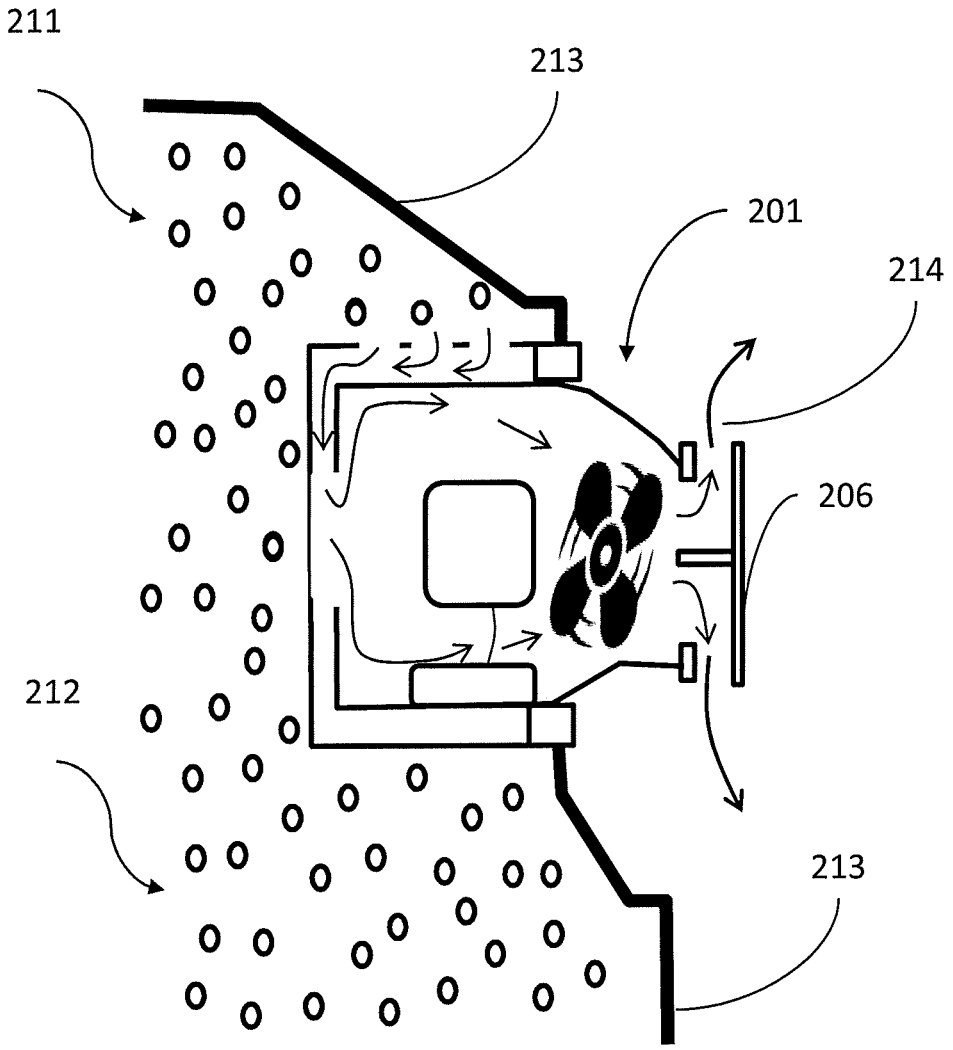
FIG. 2C represents the air extractor shown in FIG. 2A in which the flap is in an open position.

The air extractor 201 includes an air inlet 203 and an air outlet 214, shown more particularly in FIG. 2C. The air extractor 201 also includes a ventilation chamber 210. Said ventilation chamber 210 is advantageously disposed between said air inlet 203 and said air outlet 214 of the air extractor 201. The ventilation chamber 210 includes a fan 202. By fan is meant any means for generating a flow of air between the air inlet 203 and the air outlet 214.

The fan 202 may be a radial fan, an axial fan or any other type of fan. In one embodiment, the fan 202 is designed to generate a flow of air at the air outlet at a velocity substantially equal to 5 metres per second. In one embodiment, the fan 202 is designed to generate a flow of air at the air outlet between 100 and 500 L/min inclusive.

As shown in FIG. 2B, the air extractor 201 is arranged in the rear and upper part of a headlight 213, in a manner similar to the FIG. 1 diagram. The air inlet 203 is adapted to be positioned inside the headlight 213. The air outlet 214 is adapted to be outside the headlight 213. The fan 202 therefore enables aspiration of internal hot air inside the headlight 213 via the air inlet 203 and expulsion thereof to the exterior of the headlight 213 and the air outlet 214 of the air extractor.

The air extractor 201 also includes a system sealing at least against external particles. In one nonlimiting embodiment, the sealing system is also airtight. The sealing system against external particles enables external particles present in the air outside the headlight 213 to be prevented from penetrating to the interior of the headlight 213 when the fan is turned off or when the fan is not activated.

In fact, when the air extractor 201 is operating, a through-flow of air is generated from the air inlet 203 to the air outlet 214 of the air extractor 201. This through-flow of air prevents external particles from passing through the extractor to the interior of the headlight. However, if the fan 202 is turned off no flow of air is generated and it is therefore important, for the preservation of the components present in the headlight, to close the extraction system in order for no dust to enter the headlight via the air extractor.

In one embodiment, the air extractor does not include an air filter, which prevents creation of too high a resistance to the flow of air.

A first example of a sealing system is shown in FIG. 2A. In this first embodiment, the sealing system includes a blocking means 206. The blocking means 206 may be situated in the ventilation chamber 210, in the air inlet 203 or in the air outlet 214. The blocking means 206 may be a flap covering the entire section of the air extractor.

The blocking means 206 is designed to be able to assume or to be able to move between two positions: an open position (FIG. 2C) allowing fluidic communication between the air inlet and the air outlet of the air extractor and a closed position (FIG. 2B) for preventing at least the passage of external particles between the air outlet and the air inlet.

In one embodiment, the blocking means 206 is mobile between two limit positions: the closed position and the open position.

In the closed position, the blocking means 206 may cover a section of the air extractor so as to prevent at least external particles from passing through that section. Said section may be situated in the ventilation chamber 210, in the inlet or in the outlet of the air extractor.

The blocking means 206 may be a flap made from a gastight material or a material permeable to air and sealed against external particles.

The blocking means 206 may be mobile between a closed position (FIG. 2B) and an open position (FIG. 2C) by a movement in translation or by a system of slat(s).

The air extractor 201 may also include an air guide 204. The air guide 204 enables fluidic connection between the air inlet 203 of the air extractor and the ventilation chamber 210. The air guide 204 therefore enables the provision of an air extractor 201 including an air inlet 203 oriented toward the upper side of the extractor. This air guide 204 therefore advantageously enables placement of the air inlet 203 toward the top of the headlight. In this way, the air guide 204 allows aspiration of air from the headlight in the highest possible position, and thus the hottest air 211, rather than the cooler air 212 present in the lower part of the headlight 213. The air guide 204 includes a channel or a longitudinal pipe. In the embodiment, the air guide 204 makes it possible to form a tortuous path for the air, which also contributes to limiting the possible passage of any external particles from the exterior to the interior of the headlight, and therefore contributes to the sealing function.

The air extractor 201 may also include seals 208 to guarantee a seal between the extractor 201 and the headlight 213 and/or between the walls of the extractor 201 and the blocking means 206.

Figure 2D:
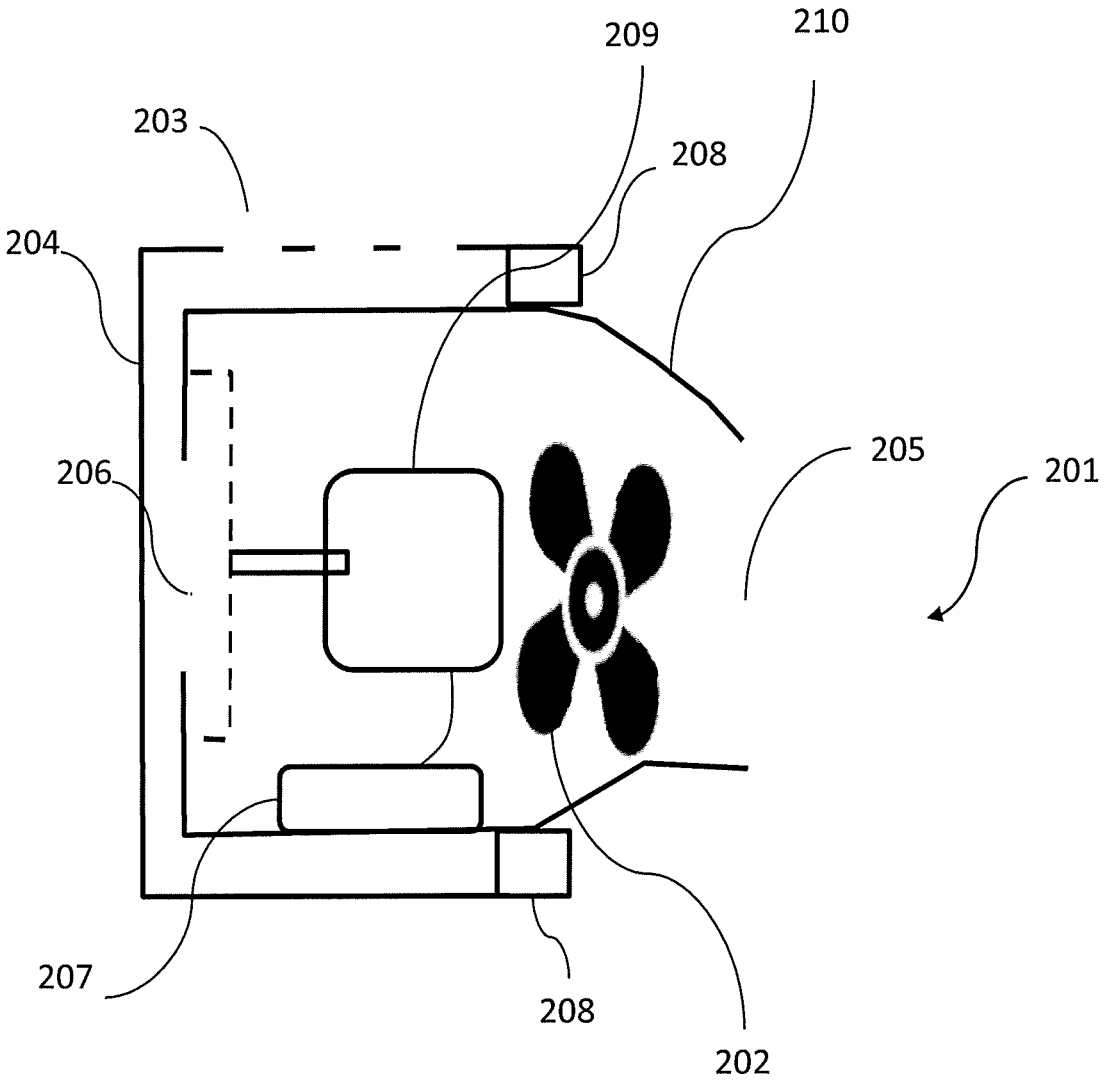
FIG. 2D represents a variant of the first embodiment of the air extractor from FIG. 2A in which the flap is arranged at the inlet of the ventilation chamber.

FIG. 2D shows a variant of the first embodiment in which the blocking means 206 is disposed at the inlet of the ventilation chamber 210. The two variant embodiments may equally be combined.

In this first embodiment, the headlight further includes a control device 209 of the air extractor 201, represented in FIGS. 2A and 2D. This control device may include an activator, adapted to control the opening and the closing of the at least one blocking means 206. The activator 209 may include a motor or a driven arm enabling movement of the blocking means 206. The control device may further include a processor 207 and/or a printed circuit. The processor may be connected to the activator 209 by a communication means in order to control the blocking means via the activator.

The control device is configured to trigger operation of the air extractor when the engine of the vehicle 101 is started and to stop it when the engine is stopped.

Figure 3A:
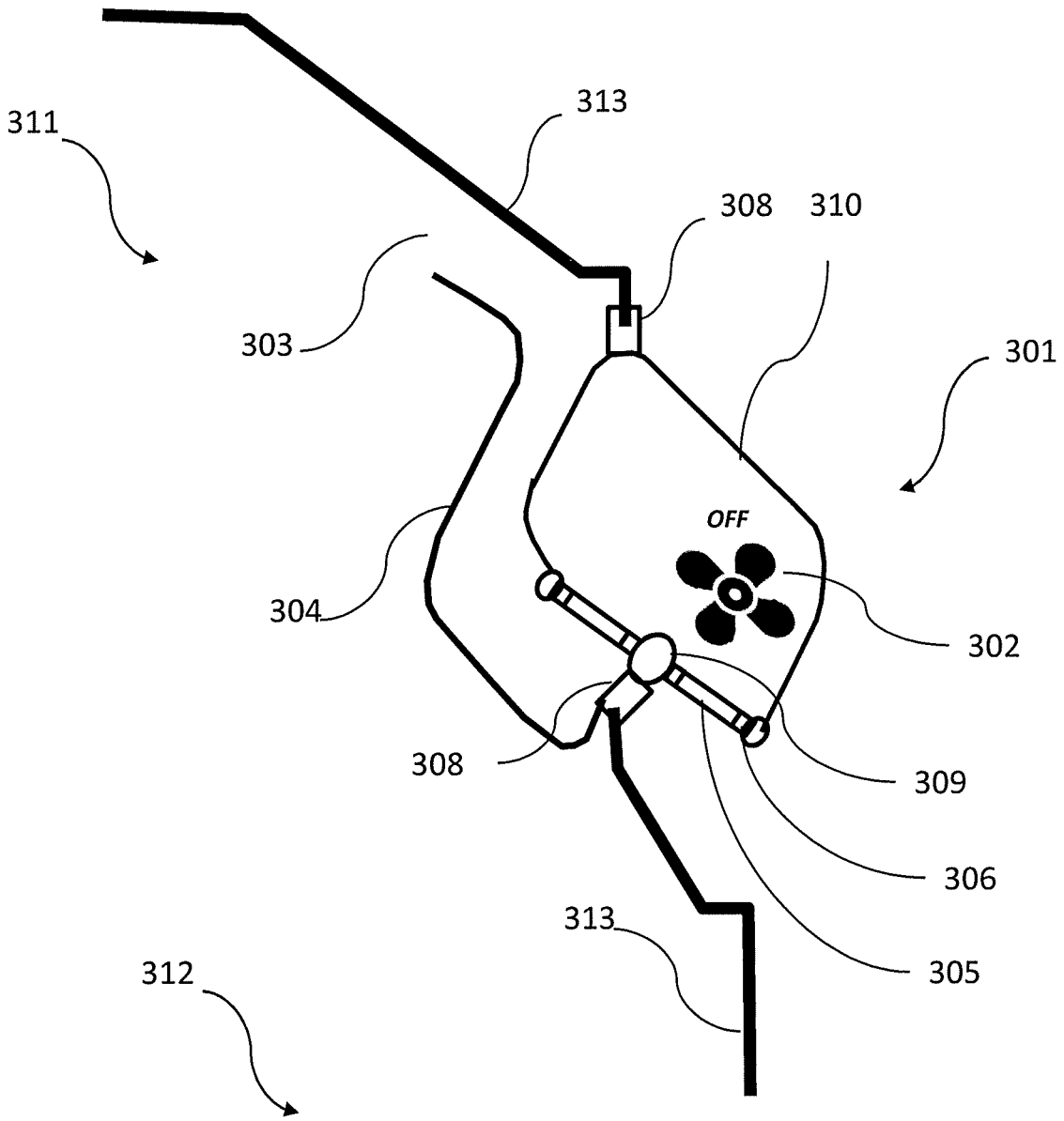
FIG. 3A represents an air extractor according to a second embodiment of the invention in which the sealing system includes at least one slat and in which the slat is in a closed position.
Figure 3B:
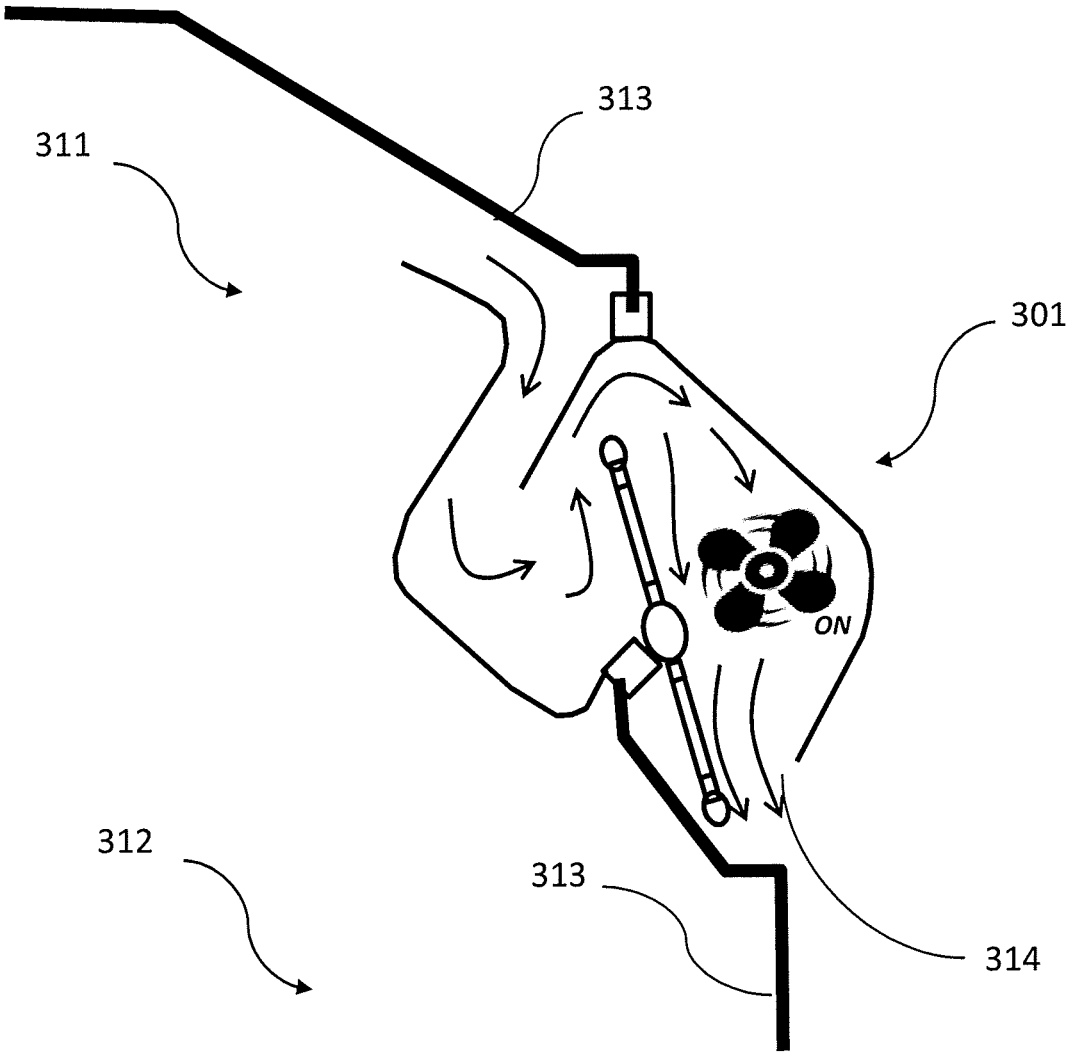
FIG. 3B represents the air extractor shown in FIG. 3A in which the slat is in an open position.

FIGS. 3A and 3B represent an air extractor 301 according to a second embodiment, in a closed configuration and in an open configuration, respectively.

In this embodiment, the air extractor 301 includes at least one blocking means 306 mobile in rotation. In particular, the blocking means 306 may be mobile in rotation about a pivot 309 oriented in the transverse direction. This blocking means 306 is designed, when in the closed position represented in FIG. 3A, simultaneously to close the inlet and the outlet of the ventilation chamber 310. When in the open position represented in FIG. 3B, it simultaneously opens the inlet and the outlet of the ventilation chamber 310. Alternatively, this blocking means could open and close the air inlet 303 and the outlet 314 of the air extractor 301.

The blocking means 306 is of sufficient length on either side of the pivot 309 so as, when in the closed position, to be able to cover the section of the inlet of the ventilation chamber 310 and the section of the outlet of the ventilation chamber 310.

The ventilation chamber 310 may include seals 308 disposed between the pivot 309 and the wall 313 of the headlight. The extractor 301 may equally include a seal 308 between the ventilation chamber and the walls of the headlight.

The blocking means 306 may include a surface 305 sealed against external particles and permeable to gases.

The air extractor 301 further includes an air guide 304 designed so that the air inlet of the extractor 303 is oriented upward or toward the upper face of the headlight 313. The extractor 301 is therefore able to aspirate the hottest gases 311 rather than the cooler gases 312 situated in the lower part of the headlight.

Figure 4:
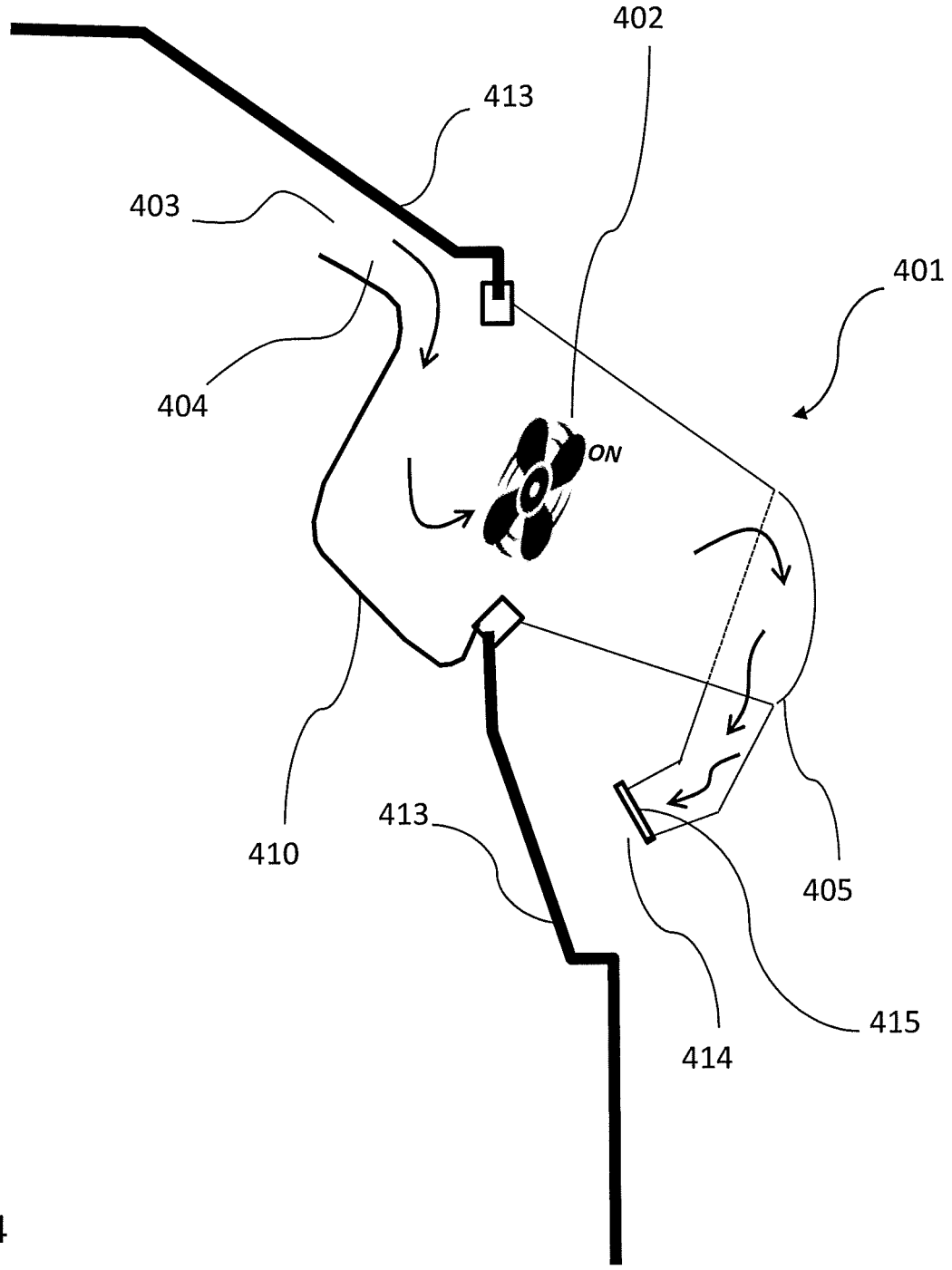
FIG. 4 represents an air extractor according to a third embodiment in which the sealing system is a channel extending from the outlet of the ventilation chamber.

In a third embodiment illustrated by FIG. 4, an air extractor 401 likewise includes an air inlet 403 and then an air guide 404 leading to a ventilation chamber 410 equipped with at least one fan 402. In this embodiment, the sealing system includes an outlet channel 405 having at least one bend. This outlet channel 405 having at least one bend is arranged between the ventilation chamber 410 containing the fan 402 and the air outlet 414 of the air extractor 404. Alternatively, the outlet channel 405 may include a plurality of bends. Said outlet channel 405 preferably includes a bend between 150° and 200° inclusive, that is to say it guides the air extracted by the air extractor 401 along a path including this kind of sharp bend before it exits the extractor. A curve of this kind, around substantially 180°, enables the air channel 405 to orient the air outlet 414 toward the rear wall of the headlight 413. The air outlet 414 is therefore not oriented toward the engine of the vehicle. This orientation makes it impossible or very difficult, when the fan is switched off, for external particles to penetrate to the interior of the headlight via the air extractor. The outlet channel 405 therefore provides the sealing function. Alternatively, the sealing system could be implemented by any other channel having at least one bend, not necessarily positioned at the level of the outlet of the air extractor.

In one embodiment, the outlet channel 405 further includes a filter or a grille 415 in the vicinity of the air outlet 414. This grille makes it possible to slow or to stop external particles, which will tend to be deposited on this grille rather than to follow the path through the outlet channel 405.

The grille 415 covers the section of the outlet channel 405. The grille preferably covers the entirety of the section of the outlet channel 405 at the level of the arrow 414. The grille preferably includes a succession of slats or filaments. The spacing between adjacent slats or between adjacent filaments is between 0.5 and 3 mm inclusive.

The outlet channel 405 preferably further extends over a sufficient length to provide the seal of the air extractor 401 against the external particles. The outlet channel 405 may extend over a length at least greater than 25 mm and/or less than 200 mm.

The diameter or the width of the section of the outlet channel 405 may be between 15 and 50 mm inclusive. The dimensions of the section of the outlet channel 405 contribute to sealing the air extractor 401 whilst allowing the passage of the flow of air when the fan 402 is operating.

The advantage of this solution is that it dispenses with the use of mechanical devices such as mobile blocking means, such as slats. This solution may advantageously also dispense with the air filter.

The outlet channel 405 may equally be designed so that, once mounted on the headlight 413 and on a vehicle, it has a slope so that any water present in the outlet channel, for example after spraying water or through condensation, is evacuated by gravity via the air outlet 414 of the extractor 401. When the air extractor is mounted on a headlight on a vehicle, the air outlet 414 is advantageously arranged at a lower height than the air outlet of the ventilation chamber 410.

In a complementary manner, in all the embodiments the ventilation chamber is designed to have a slope relative to a horizontal plane. Once the extractor is mounted on a headlight of a vehicle, this slope allows an outlet flow of water over the walls of the ventilation chamber without penetrating into the headlight. As represented in FIGS. 2A to 4, the upper part of the ventilation chamber, disposed outside the headlight, has a slope relative to a horizontal plane so as to evacuate water. In these embodiments, water is not able to stagnate in the air extractor or penetrate into the interior of the headlight.

The invention is not limited to the embodiments described. For example, other embodiments may be obtained by eliminating the air guide of these embodiments, which remains optional. Also, any other blocking means may be envisaged. For example, a slat may be mobile with a movement other than a movement in translation or in rotation, or with a movement in translation in a direction other than that described for the first embodiment, or in rotation about an axis oriented in a direction other than that described for the second embodiment.

Also, the at least one blocking means may include at least two or a plurality of slats. In this case, the various slats are configured to effect a synchronized movement in rotation. Each slat is arranged so that, when in the closed position, it covers a part of the section of the air extractor. The slats are such that, when they are all in the closed position, they together cover the entirety of the section of the air extractor. For example, in one embodiment, the at least one blocking means includes a double slat.

Also, in all the embodiments, the air extractor includes a control device such as that described with reference to the first embodiment.

That control device may moreover implement a method for extraction of air from a headlight, including in particular a method of activating the air extractor, triggered automatically on starting the motor vehicle and stopped automatically on stopping the engine of the motor vehicle. The headlight and/or the air extractor therefore includes a mobile blocking means and includes hardware and/or software elements for implementing the air extraction method.

In an embodiment associated with a mobile slat air extractor, as in accordance with the first or the second embodiment of the invention, the method of activating the air extractor advantageously includes the following steps:

activating the fan, then moving the blocker or the at least one blocker to reach an open position.

The movement step is preferably executed at least one second, preferably at least three or four seconds, most preferably between three and six seconds after the execution of the activation step. In this way, activation of the fan brings about the pressurization of the ventilation chamber before the blocking means is opened. This increased pressure advantageously makes it possible to guarantee that no dust can enter the interior of the headlight via the extractor when it is started up.

The step of activating the fan may be preceded by a step of receiving a control signal, for example a signal generated when the engine is switched on, is powered up.

Similarly, the method for deactivating the extractor includes the following steps:

moving the blocking means into the closed position, deactivating the fan.

The deactivation step is preferably executed at least one second, preferably at least three or four seconds, most preferably between three and six seconds after executing the movement step. In this way it is possible to guarantee that no dust is able to enter the interior of the headlight via the extractor when it is turned off.

The movement step may be preceded by a step of receiving a control signal, for example a signal generated when the engine is turned off, is powered down.

The invention claimed is:

1. A vehicle headlight air extractor comprising:

an air inlet and an air outlet;

a ventilation chamber disposed between the air inlet and the air outlet of the air extractor, the ventilation chamber including a fan adapted to produce a flow of air from the air inlet to the air outlet;

a sealing system against external particles; and an air guide which enables fluid communication between the air inlet and an inlet of the ventilation chamber, wherein the air guide includes a first wall and a second wall, the air inlet being defined in part by the first wall, and the second wall facing the inlet of the ventilation chamber, wherein the sealing system includes a seal abutting the air guide, and wherein the sealing system seals the air inlet and the inlet of the ventilation chamber inside a headlight.

2. The air extractor according to claim 1, wherein the sealing system against external particles includes at least one blocking means designed to assume:

an open position allowing fluidic communication between the air outlet and the air inlet; and a closed position for preventing at least the passage of the external particles between the air outlet and the air inlet.

3. The air extractor according to claim 2, further comprising a control device of the at least one blocking means.

4. The air extractor according to claim 2, wherein the at least one blocking means is arranged in at least one of the air outlet or the air inlet.

5. The air extractor according to claim 2, wherein the at least one blocking means is mobile between the open position and the closed position by movement in rotation about an axis or by movement in translation.

6. The air extractor according to claim 1, wherein the sealing system against external particles includes, between the ventilation chamber and the air outlet, a channel having a bend.

7. The air extractor according to claim 6, wherein the channel has a slope when the air extractor is integrated into the headlight for evacuating liquid to the air outlet.

8. The air extractor according to claim 6, wherein the air outlet includes a grille.

9. A vehicle headlight comprising an air extractor according to claim 1.

10. The vehicle headlight according to claim 9, further including a headlight air inlet.

11. The vehicle headlight according to claim 9, wherein the air extractor is arranged on at least one of an upper or a rear part of the headlight.

12. The vehicle headlight according to claim 9, wherein the air inlet is arranged on at least one of a lower or a front part of the headlight.

13. The vehicle headlight according to claim 9, wherein the air extractor is removably fixed to the headlight.

14. The vehicle headlight according to claim 9, further including at least one optical module including at least one electronic component and at least one system for cooling the electronic component, the cooling system including only a system for cooling by conduction.

15. A method of controlling a headlight air extractor according to claim 1, the air extractor including a mobile blocking means, the method comprising:

activating the fan; and opening the blocking means.

16. The air extractor according to claim 3, wherein the at least one blocking means is arranged in at least one of the air outlet or the air inlet.

17. The air according claim 3, wherein the at least one blocking means is mobile between the open position and the closed position by movement in rotation about an axis or by movement in translation.

18. The air according to claim 7, wherein the air outlet includes a grille.

19. The vehicle headlight according to claim 10, wherein the headlight air inlet includes an air filter.

* * * * *